US007144306B1

(12) United States Patent
Yen

(10) Patent No.: US 7,144,306 B1
(45) Date of Patent: Dec. 5, 2006

(54) APPARATUS AND PROCESS FOR CYLINDRICALLY GRINDING WORKPIECES

(75) Inventor: Shih-Chieh Yen, Tu-Cheng (TW)

(73) Assignee: Hon Hai Precision Industry Co. Ltd, Taipei Hsien (TW)

( * ) Notice: Subject to any disclaimer, the term of this patent is extended or adjusted under 35 U.S.C. 154(b) by 0 days.

(21) Appl. No.: 11/402,773

(22) Filed: Apr. 12, 2006

(30) Foreign Application Priority Data

Jun. 10, 2005 (CN) ..... 200510035285

(51) Int. Cl.
*B24B 1/00* (2006.01)

(52) U.S. Cl. ..... 451/57; 451/390; 451/391; 451/384

(58) Field of Classification Search ..... 451/57, 451/26, 364–414, 438, 439, 461, 555; 269/47–52
See application file for complete search history.

(56) References Cited

U.S. PATENT DOCUMENTS

| | | | | |
|---|---|---|---|---|
| 1,336,928 | A * | 4/1920 | Simmons | 335/285 |
| 4,445,678 | A * | 5/1984 | George | 269/88 |
| 4,583,432 | A * | 4/1986 | Bricker | 82/1.11 |
| 5,305,557 | A * | 4/1994 | Warncke | 451/369 |
| 6,554,265 | B1 * | 4/2003 | Andronica | 269/268 |

* cited by examiner

*Primary Examiner*—Dung Van Nguyen
(74) *Attorney, Agent, or Firm*—Jeffrey T. Knapp

(57) ABSTRACT

An apparatus for cylindrically grinding workpieces includes a first holding tool (100) for positioning pre-grinding workpieces (60) and a second holding tool (200) for positioning partially ground workpieces (i.e. workpieces which have been ground on one side only). The first holding tool defines a first groove (12) for containing the pre-grinding workpieces to be partially ground and the second bonding defines a second groove (22) for containing the partially ground workpieces. A stopping board (23) connects one side of the second groove, and the stopping board has a projection (231) for transferring the partially ground workpieces from the first groove to the second groove. The present invention also provides a process for cylindrically grinding workpieces.

14 Claims, 4 Drawing Sheets

APPARATUS AND PROCESS FOR CYLINDRICALLY GRINDING WORKPIECES

BACKGROUND OF THE INVENTION

1. Field of the Invention

The present invention generally relates to cylindrical grinding apparatuses and processes and, more particularly, to a holder for holding workpieces during a cylindrically grinding process and a holding method for such a process.

2. Discussion of the Related Art

Usually, optical elements such as camera lenses and spectacles are in used in cylindrical form. However, original optical workpieces (i.e. lens blanks) are most easily manufactured in the form of a square. Therefore, these original optical workpieces have to be cylindrically ground before use.

A typical example of a contemporary cylindrical grinding apparatus is a centering apparatus. The centering apparatus typically includes a pair of holders for holding the original workpiece, where each holder has a hollow chamber communicating with a surface of the holder. The holder can hold the workpiece on its surface by using an air pump pumping the hollow chamber, a grinding wheel is then used to cylindrically grind the workpiece. However, the centering apparatus can only cylindrically grind one piece of workpiece at a time.

FIGS. 6–7 show an apparatus for cylindrically grinding more than one workpiece at a time. The apparatus includes a first holding tool 30 and a second holding tool 40. The first holding tool 30 defines a holding groove 32, and the second holding tool 40 defines a semicircular groove 42. The holding groove 32 and the semicircular groove 42 are both for securing the workpieces 50 in the holding tools 30, 40. In use, firstly, a plurality of workpieces 50 are placed in the holding groove 32 of the first holding tool 30. Secondly, the workpieces 50 are bonded together using adhesive. Thirdly, a grinding wheel is used to grind a portion of the workpieces 50 projecting out of the holding groove 32 into a semicircular shape. Fourthly, the semicircular portion 51 of the workpieces 50 is transferred to the semicircular groove 42 of the second holding tool 40. Fifthly, the other portion of the workpieces 50 is also ground into a semicircular shape using the grinding wheel. The final result being that the workpieces 50 are ground to a cylindrical shape.

When transferring the workpieces 50 from the first holding tool 30 to the second holding tool 40, the adhesive should be dissolved so that the workpieces 50 can be taken out of the first holding tool 30. However, the workpieces 50 will not be compact in the second holding tool 40 because the workpieces 50 will be disarrayed whilst the adhesive is dissolved.

Therefore, an apparatus and a process for cylindrically grinding workpieces which can easily and compactly transfer the workpieces is desired.

SUMMARY OF THE INVENTION

In one aspect, an apparatus for cylindrically grinding workpieces includes a first holding tool for positioning pre-grinding workpieces and a second holding tool for positioning partially ground workpieces (i.e. workpieces which have been ground on one side only). The first holding tool defines a first groove for containing the pre-grinding workpieces to be partially ground and the second bonding defines a second groove for containing the partially ground workpieces. A stopping board connects one side of the second groove, and the stopping board has a projection for transferring the partially ground workpieces from the first groove to the second groove.

In another aspect of the preferred embodiment, a process for grinding workpieces can be used wherein a plurality of pre-grinding workpieces are positioned in a first groove of a first holding tool with a first portion of the pre-grinding workpieces projecting out of the first groove. The first portion of the pre-grinding workpieces is partially ground into a first predetermined shape. A second holding tool is provided, the second holding tool defining a second groove and a stopping board connecting to one side of the second groove, the stopping board having a projection. The second holding tool is then placed on the partially ground workpieces with the first portion in the second groove. The second holding tool is then moved with the projection pushing the workpieces a predetermined distance. The position of the two holding tools is then reversed, with the first holding tool being placed on the second holding tool. The first holding tool is then moved until the partially ground workpieces completely leave the first groove, a second portion of the workpieces then projects out of the second groove, this second portion is then ground into a second predetermined shape thus completing the grinding process.

Other advantages and novel features will become more apparent from the following detailed description when taken in conjunction with the accompanying drawings.

BRIEF DESCRIPTION OF THE DRAWINGS

Many aspects of the apparatus can be better understood with reference to the following drawings. The components in the drawings are not necessarily drawn to scale, the emphasis instead being placed upon clearly illustrating the principles of the present apparatus. Moreover, in the drawings, like reference numerals designate corresponding parts throughout the several views.

DETAILED DESCRIPTION OF THE EMBODIMENT

Figure 1:
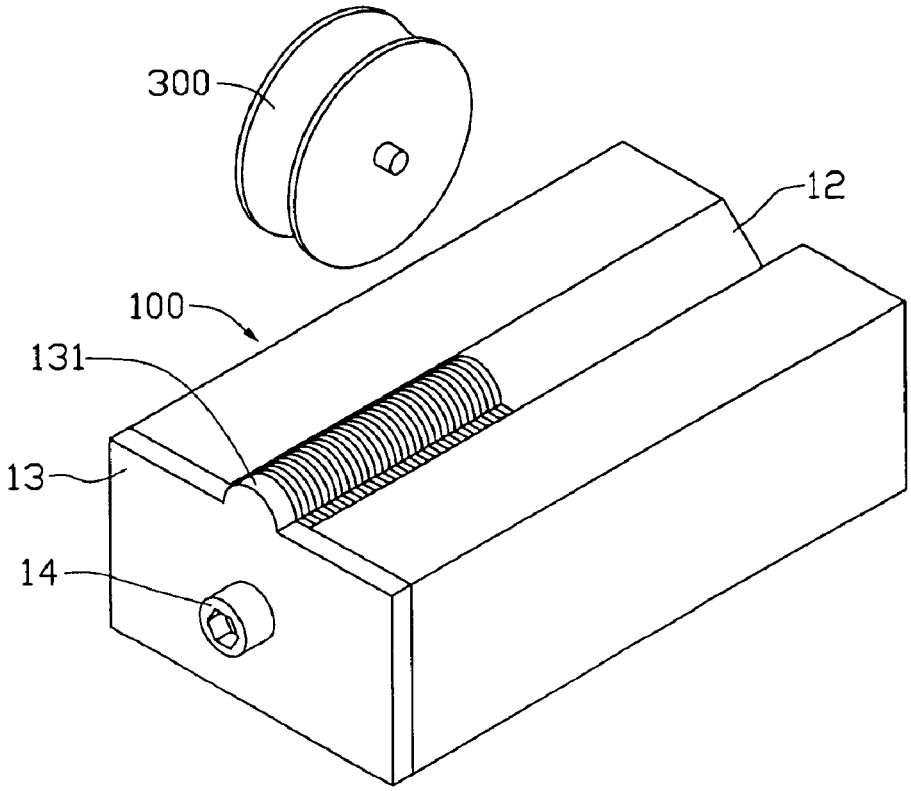
FIG. 1 is a schematic view of a first holding tool of an apparatus for cylindrically grinding workpieces in accordance with a preferred embodiment.
Figure 2:
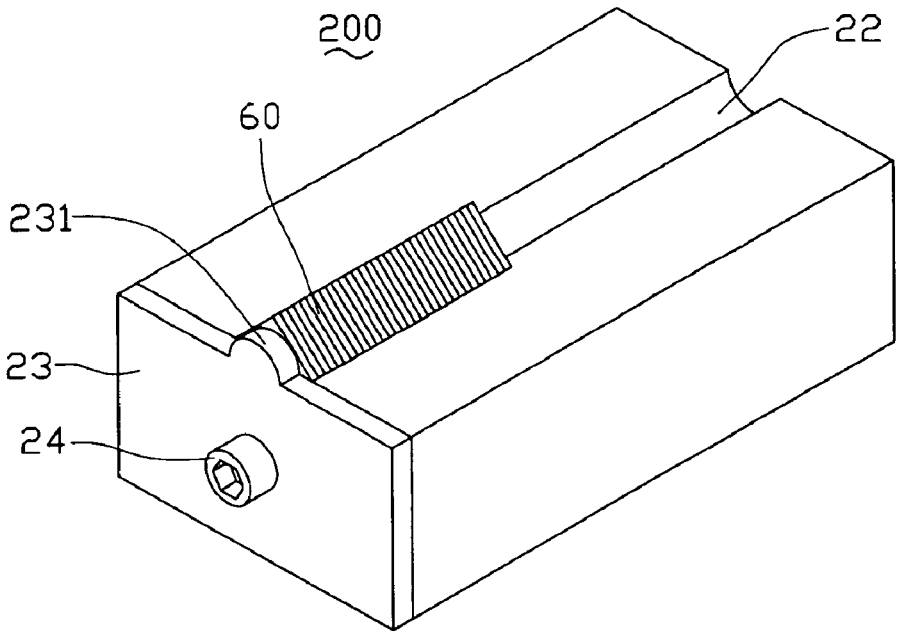
FIG. 2 is a schematic view of a second holding tool of the apparatus for cylindrically grinding workpieces in accordance with a preferred embodiment.

Referring to FIGS. 1–2, in a preferred embodiment, an apparatus for cylindrically grinding workpieces 60, includes a first holding tool 100, a second holding tool 200, and a grinding wheel 300. The holding tools 100, 200 are configured for bonding workpieces 60.

Figure 3:
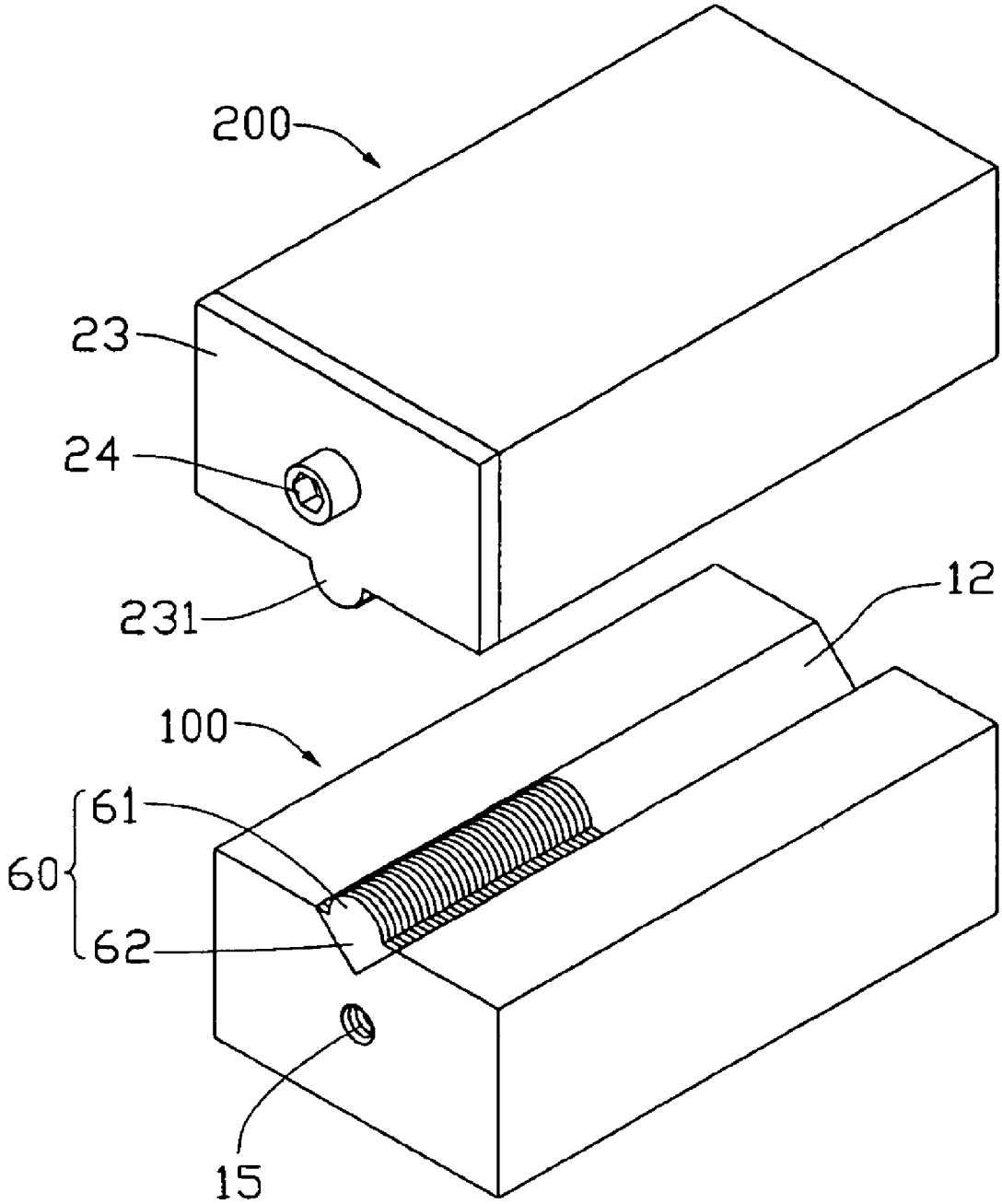
FIG. 3 is a schematic view of a step of the process for cylindrically grinding workpieces in accordance with a preferred embodiment.

The first holding tool 100 defines a first groove 12 for containing pre-grinding workpieces 60. The pre-grinding workpieces 60 can be optical elements having a non-cylindrical shape. In this preferred embodiment, the workpieces 60 are in substantially square form. Therefore, the first groove 12 is configured to have a V-shaped cross section, for compliantly receiving the pre-grinding workpieces 60 therein. Understandably, the cross section of the first groove 12 can be of other shape depending on the form of the pre-grinding workpieces 60. The pre-grinding worpieces 60 are partially ground on the first groove 12 using the grinding wheel 300. A first stopping board 13 detachably connects one side of the first holding tool 100 by means of bolt or adhesive. In this preferred embodiment, the first stopping board 13 connects the first holding tool 100 by means of cooperation of a first bolt 14 and a screw thread 15 (as shown in FIG. 3). The first stopping board 13 has a first projection 131 for preventing workpieces 60 moving out of the first groove 12 during the grinding process.

The second holding tool defines a second groove 22 for containing the partially ground workpieces 60. The second groove 22 is configured to have a semicircular cross section. The partially ground workpieces 60 are ground to be cylinder shape on the second groove 22. A second stopping board 23 detachably connects one side of the second holding tool 200 using a second bolt 24. The second stopping board 23 has a second projection 231 used for preventing workpieces 60 moving out of the second groove 22 during grinding process, and for transferring the partially ground workpieces 60 from the first groove 12 to the second groove 22.

Figure 4:
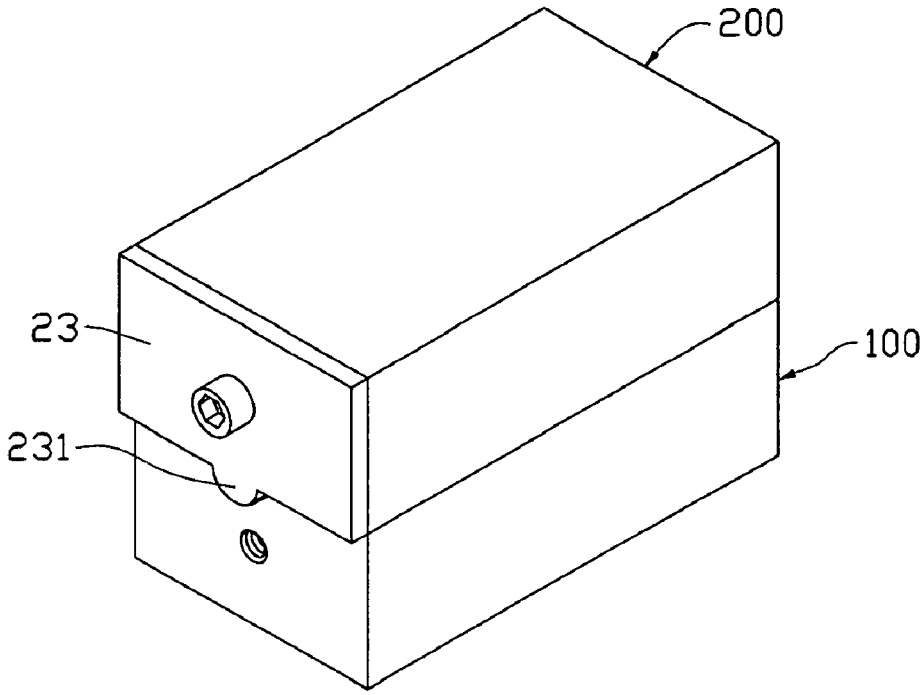
FIG. 4 is a schematic view of another step subsequent to the step in FIG. 3.
Figure 5:
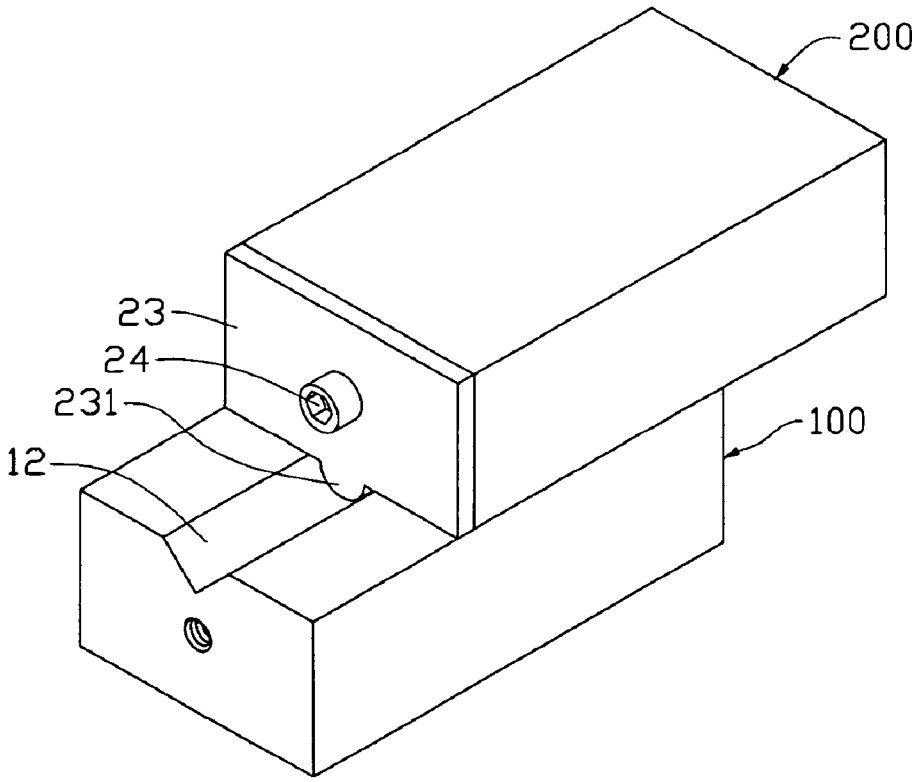
FIG. 5 is a schematic view of a further step subsequent to the step in FIG. 4.
Figure 6:
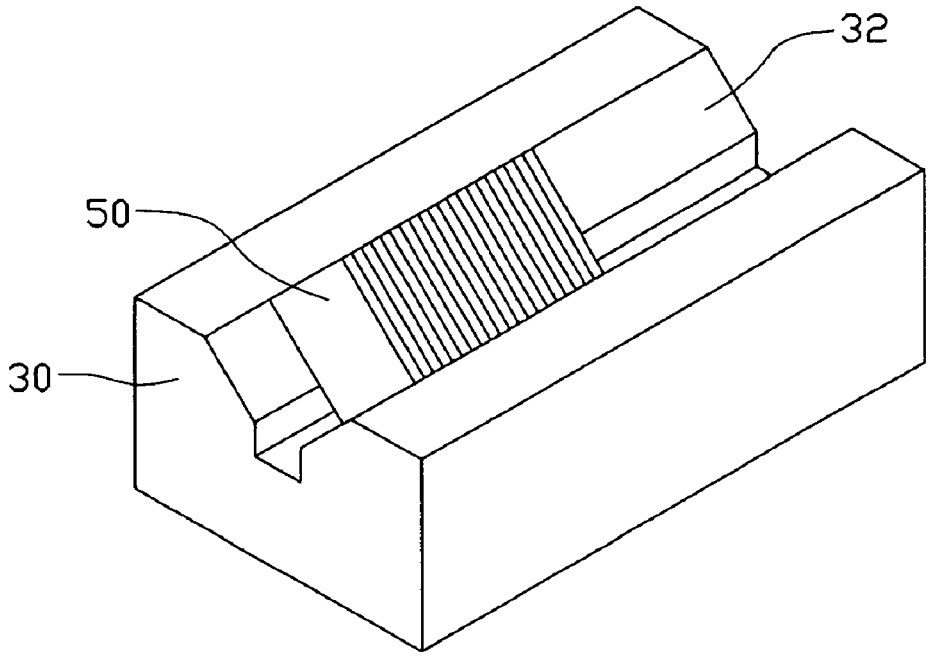
FIG. 6 (PRIOR ART)
FIG. 6 is a schematic view of a first holding tool for cylindrically grinding workpieces from the prior art.
Figure 7:
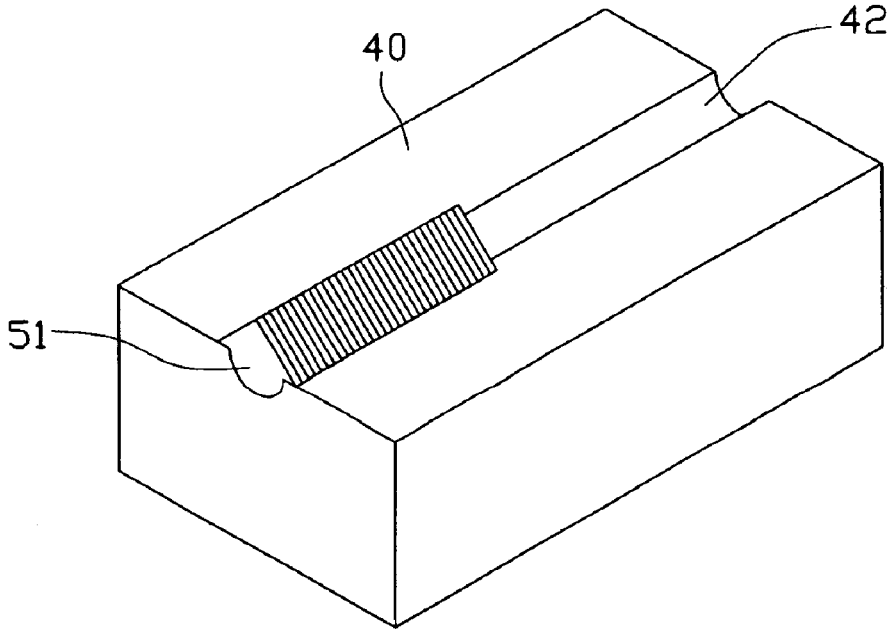
FIG. 7 (PRIOR ART)
FIG. 7 is a schematic view of a second holding tool for cylindrically grinding workpieces from the prior art.

Referring to FIGS. 3–5, an exemplary process for cylindrically grinding workpieces 60 includes the steps of (1) A stack of workpieces 60 (i.e. pre-grinding workpieces) are placed in the first groove 12 of the first holding tool 100. A first portion 61 of the pre-grinding workpieces 60 projects out of the first groove 12.

(2) The pre-grinding workpieces 60 are bonded together in the first groove using adhesive.

(3) The first portion 61 of the pre-grinding workpieces 60 is partially ground to a semicircular shape.

(4) The first stopping board 13 is detached from the first holding tool 100. The second holding tool 200 are placed on the partially ground workpieces 60 with the first portion 61 in the second groove 22.

(5) The second holding tool 200 is moved with the second projection 231 pushing the workpieces 60 a predetermined distance along the second groove 22.

(6) The two holding tools 100, 200 are reversed with the first holding tool 100 being on the second holding tool 200.

(7) The first holding tool 100 is moved toward the projection 231 until the partially ground workpieces 60 completely leave the first groove 12. A second portion 62 of the workpieces 60 projects out of the second groove 22.

(8) The second portion 62 of the workpieces 60 is ground to a semicircular shape. Thereby, a plurality of cylindrical workpieces 60 are obtained.

The process can easily and compactly transfer workpieces 60 from the first groove 12 to the second groove 22 using the stopping board 23, which can promote the working efficiency of the cylindrical process.

It is believed that the present embodiments and their advantages will be understood from the foregoing description, and it will be apparent that various changes may be made thereto without departing from the spirit and scope of the invention or sacrificing all of its material advantages, the examples here before described merely being preferred or exemplary embodiments of the invention.

What is claimed is:

1. An apparatus for cylindrically grinding workpieces, comprising:

a first holding tool for positioning pre-grinding workpieces, the first holding tool defining a first groove for containing the pre-grinding workpieces to be partially ground; and a second holding tool for positioning the partially ground workpieces, the second holding tool defining a second groove for containing the partially ground workpieces, and a stopping board connecting one side of the second groove;

wherein the stopping board has a projection for transferring the partially ground workpieces from the first groove to the second groove.

2. The apparatus as claimed in claim 1, wherein the first groove has a V-shaped cross section.

3. The apparatus as claimed in claim 1, wherein the stopping board detachably connects the second holding tool by means of bolt or adhesive.

4. The apparatus as claimed in claim 1, wherein the projection of the stopping board is semicircular shaped.

5. The apparatus as claimed in claim 1, wherein the first holding tool has a first stopping board connected one side of the first groove.

6. The apparatus as claimed in claim 5, wherein the first stopping board has a first projection for preventing workpieces moving out of the first groove during the grinding process.

7. The apparatus as claimed in claim 6, wherein the first projection of the first stopping board is semicircular shaped.

8. A process for grinding workpieces, comprising the steps of:

positioning a plurality of pre-grinding workpieces in a first groove of a first holding tool, with a first portion of the pre-grinding workpieces projecting out of the first groove;

partially grinding the first portion of the pre-grinding workpieces to a first predetermined shape;

providing a second holding tool, the second holding tool having a second groove and a stopping board connecting one side of the second groove, the stopping board having a projection;

placing the second holding tool on the partially ground workpieces, with the first portion in the second groove;

moving the second holding tool, with the projection pushing the partially ground workpieces a predetermined distance;

reversing the two holing tools, with the first holding tool being on the second holding tool;

moving the first holding tool until the partially ground workpieces completely leave the first groove, a second portion of the workpieces projecting out of the second groove; and grinding the second portion of the workpieces to a second predetermined shape.

9. The process as claimed in claim 8, the workpieces are positioned in the first groove by bonding the workpieces together with adhesive.

10. The process as claimed in claim 9, further comprising a step of detaching and cleaning the bonded workpieces after grinding the second portion of the workpieces.

11. The process as claimed in claim 8, wherein the workpieces are ground using a grinding wheel.

12. The process as claimed in claim 8, wherein the first and second predetermined shapes are each semicircular shape.

13. An apparatus for holding a stack of bonded workpieces in a grinding process, the apparatus comprising:

a first holding tool, wherein the first holding tool has a first positioning groove for positioning pre-grinding workpieces to be partially ground, the first positioning groove has a first cross section corresponding to an outer periphery of the pre-grinding workpieces; and a second holding tool, wherein the second holding tool has a second positioning groove for positioning the partially ground workpieces for further grinding, the second positioning groove receiving ground portions of the partially ground workpieces and has a second cross section corresponding to the ground portions; and a projecting member fixed relative to the second holding tool and aligning with the second positioning groove, wherein the projecting member moves the partially ground workpieces along the first positioning groove so as to compactly transfer the workpieces from the first holding tool to the second holding tool when the first and second holding tools are placed upon and move relative to each other.

14. The apparatus of claim 13, wherein the first positioning groove is substantially V-shaped, and the second positioning groove is substantially semicircular shaped.

* * * * *